US009500370B2

(12) United States Patent
Barker

(10) Patent No.: US 9,500,370 B2
(45) Date of Patent: Nov. 22, 2016

(54) APPARATUS FOR MIXING FUEL IN A GAS TURBINE NOZZLE

(71) Applicant: General Electric Company, Schenectady, NY (US)

(72) Inventor: Carl Robert Barker, Simpsonville, SC (US)

(73) Assignee: General Electric Company, Schenectady, NY (US)

( * ) Notice: Subject to any disclaimer, the term of this patent is extended or adjusted under 35 U.S.C. 154(b) by 532 days.

(21) Appl. No.: 14/136,353

(22) Filed: Dec. 20, 2013

(65) Prior Publication Data

US 2015/0176841 A1 Jun. 25, 2015

(51) Int. Cl.

| | |
|---|---|
| ***F23R 3/28*** | (2006.01) |
| ***F23R 3/32*** | (2006.01) |
| ***F23R 3/30*** | (2006.01) |
| ***F23R 3/10*** | (2006.01) |
| ***F23R 3/04*** | (2006.01) |
| ***F23R 3/00*** | (2006.01) |

(52) U.S. Cl.

CPC ..... *F23R 3/286* (2013.01); *F23R 3/10* (2013.01); *F23R 3/283* (2013.01); *F23R 3/30* (2013.01); *F23R 3/32* (2013.01); *F23R 3/002* (2013.01); *F23R 3/04* (2013.01); *F23R 3/045* (2013.01); *F23R 3/28* (2013.01)

(58) Field of Classification Search

CPC ..... F23R 3/002; F23R 3/04; F23R 3/045; F23R 3/10; F23R 3/28; F23R 3/286; F23R 3/283; F23R 3/32; F02C 7/22; F02C 7/222

See application file for complete search history.

(56) References Cited

U.S. PATENT DOCUMENTS

| | | | | |
|---|---|---|---|---|
| 5,274,991 | A | 1/1994 | Fitts | |
| 5,647,432 | A | 7/1997 | Rexford et al. | |
| 5,713,206 | A | 2/1998 | McWhirter et al. | |
| 6,394,791 | B2 | 5/2002 | Smith et al. | |
| 6,983,600 | B1 | 1/2006 | Dinu et al. | |
| 7,617,682 | B2 | 11/2009 | Bruck | |
| 8,281,600 | B2 * | 10/2012 | Chen | F02C 7/18 60/752 |
| 2010/0050640 | A1 | 3/2010 | Belsom et al. | |
| 2012/0291440 | A1 * | 11/2012 | Moehrle | F23R 3/60 60/737 |

* cited by examiner

*Primary Examiner* — Ehud Gartenberg
*Assistant Examiner* — Jared W Pike
(74) *Attorney, Agent, or Firm* — Mark E. Henderson; Ernest G. Cusick; Frank A. Landgraff

(57) ABSTRACT

A fuel nozzle in a combustion turbine engine that includes: a fuel plenum defined between an circumferentially extending shroud and axially by a forward tube-sheet and an aft tube-sheet; and a mixing-tube that extends across the fuel plenum that defines a passageway connecting an inlet formed through the forward tube-sheet and an outlet formed through the aft tube-sheet, the mixing-tube comprising one or more fuel ports that fluidly communicate with the fuel plenum. The mixing-tube may include grooves on an outer surface, and be attached to the forward tube-sheet by a connection having a fail-safe leakage path.

18 Claims, 6 Drawing Sheets

APPARATUS FOR MIXING FUEL IN A GAS TURBINE NOZZLE

FEDERAL RESEARCH STATEMENT

This invention was made with Government support under Contract No. DE-FC26-05NT42643, awarded by the Department of Energy. The Government has certain rights in the invention.

BACKGROUND OF THE INVENTION

The present invention generally involves an apparatus and method for supplying fuel to a gas turbine. Specifically, the present invention describes a nozzle that may be used to supply fuel to a combustor in a gas turbine.

Gas turbines are widely used in industrial and power generation operations. A typical gas turbine includes an axial compressor at the front, one or more combustors around the middle, and a turbine at the rear. Ambient air enters the compressor, and rotating blades and stationary vanes in the compressor progressively impart kinetic energy to the working fluid (air) to produce a compressed working fluid at a highly energized state. The compressed working fluid exits the compressor and flows through nozzles in the combustors where it mixes with fuel and ignites to generate combustion gases having a high temperature, pressure, and velocity. The combustion gases expand in the turbine to produce work. For example, expansion of the combustion gases in the turbine may rotate a shaft connected to a generator to produce electricity.

It is widely known that the thermodynamic efficiency of a gas turbine increases as the operating temperature, namely the combustion gas temperature, increases. However, if the fuel and air are not evenly mixed prior to combustion, localized hot spots may form in the combustor near the nozzle exits. The localized hot spots increase the chance for flame flash back and flame holding to occur which may damage the nozzles. Although flame flash back and flame holding may occur with any fuel, they occur more readily with fuels that have a higher reactivity, such as hydrogen, that have a higher burning rate and wider flammability range. The localized hot spots may also increase the production of nitrous oxides, carbon monoxide, and unburned hydrocarbons, all of which are undesirable exhaust emissions.

A variety of techniques exist to allow higher operating temperatures while minimizing localized hot spots and undesirable emissions. Nevertheless, the risk of fuel leaks, as well as the damaging flame flash back and holding, that usually results from such leaks, remain a significant industry concern. These issues also exist in so-called "micromixer" fuel nozzles because each nozzle employs a number of separate "micro" mixing-tubes so to produce a more uniform fuel/air mixture for combustion. As one of ordinary skill in the art will appreciate, a more uniform fuel/air mixture offers several performance advantages. However, known design configurations of these type of fuel nozzles are less than ideal. The multiple tubes and more complicated arrangement has resulted in a fuel nozzle that is expensive to manufacture and susceptible to fuel leakage and the damaging flashback and flame holding that typically comes with such leaks.

As a result, novel designs that simplify these types of fuel nozzles, while still achieving the performance advantages associated with the improved premixing of the fuel and air, would be prized in the marketplace. Specifically, new designs that allow for a more robust, cost-effective fuel nozzle that decreases the likelihood of leaks while also limiting the damage that typically attends such leaks when they occur, would represent a meaningful advancement in this technological area.

BRIEF DESCRIPTION OF THE INVENTION

The present application thus describes a fuel nozzle in a combustion turbine engine that includes: a fuel plenum defined between an circumferentially extending shroud and axially by a forward tube-sheet and an aft tube-sheet; and a mixing-tube that extends across the fuel plenum that defines a passageway connecting an inlet formed through the forward tube-sheet and an outlet formed through the aft tube-sheet, the mixing-tube comprising one or more fuel ports that fluidly communicate with the fuel plenum. The mixing-tube may include grooves on an outer surface, and be attached to the forward tube-sheet by a connection having a fail-safe leakage path.

The present invention further describes a fuel nozzle for a combustor of a combustion turbine engine that includes: a fuel plenum defined by a shroud that extends between a forward tube-sheet and an aft tube-sheet; a plurality of mixing-tubes, each of which defines an enclosed passageway extending across the fuel plenum from an inlet formed through the forward tube-sheet to an outlet formed through the aft tube-sheet, wherein each of the mixing-tubes includes a plurality of fuel ports that fluidly connects the enclosed passageway to the fuel plenum. Each of the mixing-tubes may include a plurality of grooves formed on an outer surface, the plurality of grooves configured to increase a compliancy of each mixing-tube. The mixing-tube may be a non-integral component to both the forward tube-sheet and the aft tube-sheet, wherein the mixing-tube is mechanically trapped therebetween via a first tip face of the mixing-tube engaging a recessed seat formed in the inlet and a second tip face of the mixing-tube engaging a recessed seat formed in the outlet.

These and other features of the present application will become apparent upon review of the following detailed description of the preferred embodiments when taken in conjunction with the drawings and the appended claims.

BRIEF DESCRIPTION OF THE DRAWINGS

A full and enabling disclosure of the present invention, including the best mode thereof to one skilled in the art, is set forth more particularly in the remainder of the specification, including reference to the accompanying figures, in which.

DETAILED DESCRIPTION OF THE INVENTION

Figure 1:
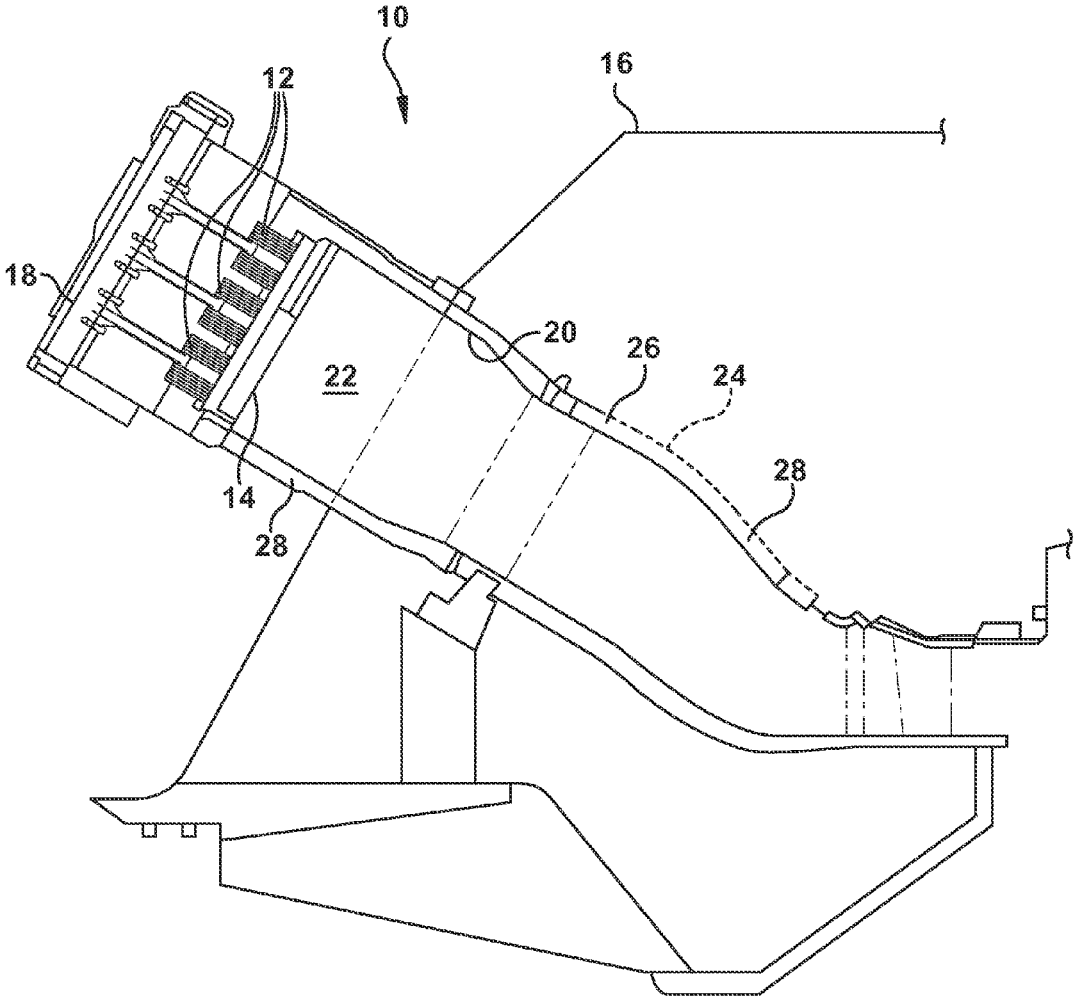
FIG. 1 is a simplified cross-section of a combustor according to one embodiment of the present invention.

Reference will now be made in detail to present embodiments of the invention, one or more examples of which are illustrated in the accompanying drawings. The detailed description uses numerical designations to refer to features in the drawings. Like or similar designations in the drawings and description have been used to refer to like or similar parts of the invention. Each example is provided by way of explanation of the invention, not limitation of the invention. In fact, it will be apparent to those skilled in the art that modifications and variations can be made in the present invention without departing from the scope or spirit thereof. For instance, features illustrated or described as part of one embodiment may be used on another embodiment to yield a still further embodiment. Thus, it is intended that the present invention covers such modifications and variations as come within the scope of the appended claims and their equivalents.

Several descriptive terms may be used regularly herein, and it may be helpful to define these terms at the onset of this section. Accordingly, these terms and their definitions, unless stated otherwise, are as follows. As used herein, "downstream" and "upstream" are terms that indicate direction relative to the flow of a fluid, such as, for example, the working fluid through the compressor, combustor and turbine sections of the gas turbine, or the flow coolant through one of the component systems of the engine. The term "downstream" corresponds to the direction of fluid flow, while the term "upstream" refers to the direction opposite or against the direction of fluid flow. The terms "forward" and "aft", without any further specificity, refer to directions relative to the orientation of the gas turbine, with "forward" referring to the forward or compressor end of the engine, and "aft" referring to the aft or turbine end of the engine. Additionally, given a gas turbine engine's configuration about a central axis as well as this same type of configuration in some component systems, terms describing position relative to an axis likely will be used. In this regard, it will be appreciated that the term "radial" refers to movement or position perpendicular to an axis. Related to this, it may be required to describe relative distance from the central axis. In this case, for example, if a first component resides closer to the center axis than a second component, it will be stated herein that the first component is "radially inward" or "inboard" of the second component. If, on the other hand, the first component resides further from the axis than the second component, it may be stated herein that the first component is "radially outward" or "outboard" of the second component. Additionally, it will be appreciated that the term "axial" refers to movement or position parallel to an axis. And, finally, the term "circumferential" refers to movement or position around an axis.

FIG. 1 shows a simplified cross-section of a combustor 10 according to one embodiment of the present invention. As shown, the combustor 10 generally includes one or more nozzles 12 radially arranged in a top cap 14. A casing 16 may surround the combustor 10 to contain the air or compressed working fluid exiting the compressor (not shown). The forward portion of the combustor 10 may be defined by an end cap 18, while a liner 20 defines a combustion chamber 22 just aft of the nozzles 12. A flow sleeve 24 with impingement or flow holes 26 may surround the liner 20 to define an annular passage 28 therebetween.

Figure 2:
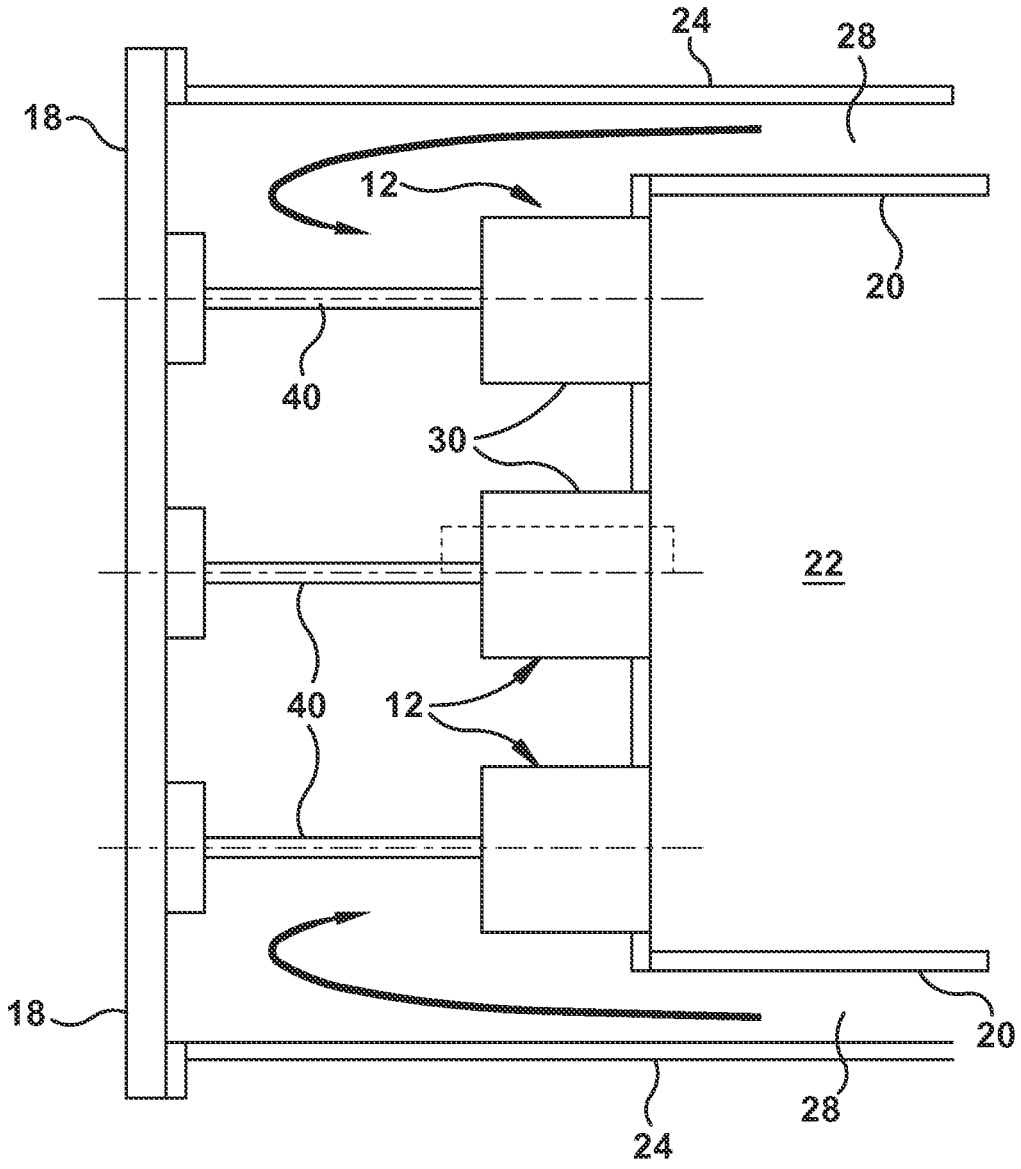
FIG. 2 is an enlarged cross-section of a portion of the combustor shown in FIG. 1.

FIG. 2 provides an enlarged cross-section of a portion of the combustor 10 shown in FIG. 1 and includes arrows that illustrated the various flow paths of the air or compressed working fluid once it enters the combustor. As indicated, the air is directed toward the front of the combustor through the annulus formed between the flow sleeve 24 and liner 20. As indicated, once the air reaches the front portion of the combustor 10, the air turns approximately 180° and enters the fuel nozzles 12 via inlets positioned on a forward side, which is illustrated more clearly in FIG. 3.

Figure 3:
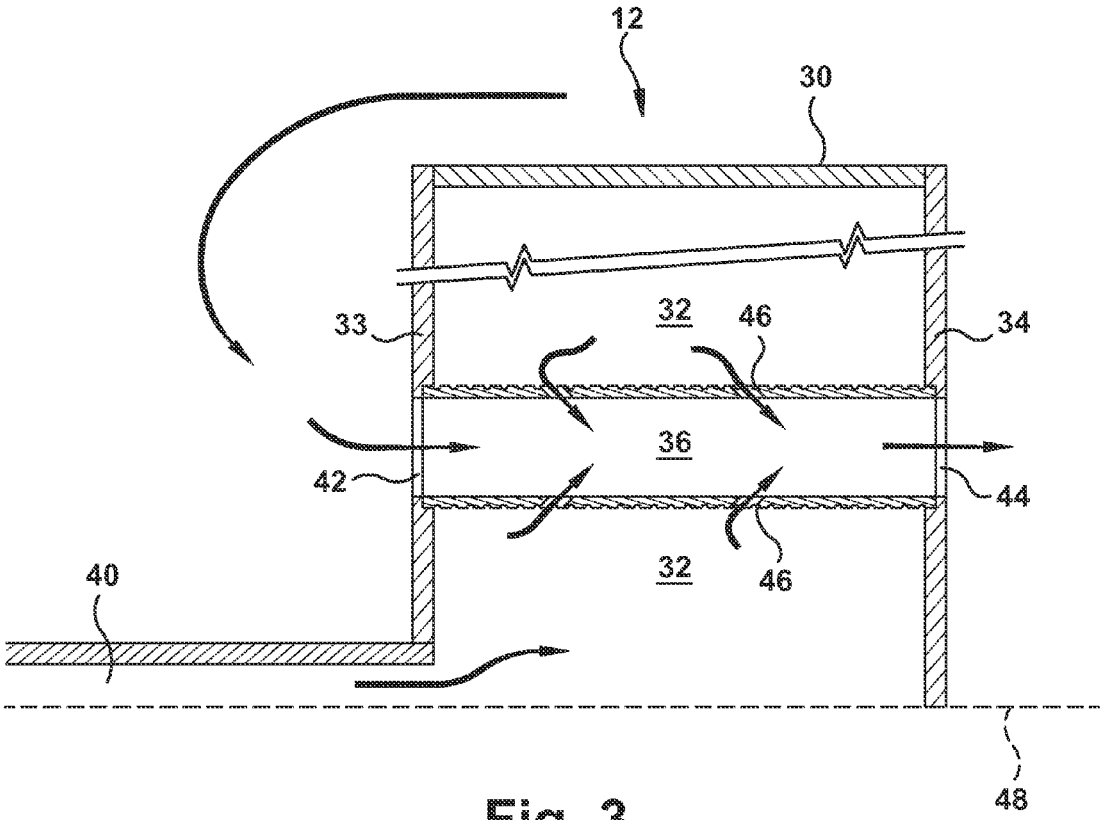
FIG. 3 is an enlarged cross-section of a fuel nozzle according to one embodiment of the present invention.

FIG. 3 provides an enlarged cross-section of a fuel nozzle 12 according to an embodiment of the present invention. As shown, the fuel nozzle 12 generally includes a shroud 30 that circumferentially surrounds and defines a fuel plenum 32. The fuel plenum 32 may be cylindrical in shape, though other shapes are also possible. The planar ends of the cylindrically shaped fuel plenum 32 are defined by a forward tube-sheet 33 and an aft tube-sheet 34. It will be appreciated that the fuel plenum 32 may be connected to a supply of fuel by a fuel conduit 40 that extends from the end cap 18.

The fuel nozzle 12 of the present invention further includes one or more mixing-tubes 36 that extend through the fuel plenum 32 between the forward tube-sheet 33 and the aft tube-sheet 34. The mixing-tubes 36, as illustrated, may be configured to provide a passage that connects an inlet 42 formed through the forward tube-sheet 33 to an outlet 44 formed through the aft tube-sheet 34. It will be appreciated that, given this configuration, the inlet 42 provides the means by which the compressed air flowing through the combustor 10 enters the fuel nozzle 12. As indicated, the mixing-tube 36 may include one or more fuel ports 46 by which the interior passageway through the mixing-tube 36 is fluidly connected to the fuel plenum 32. Thus arranged, compressed air may enter the mixing-tube 36 through the inlet 42 formed through the forward tube-sheet 33 and then the brought together with a supply of fuel flowing into the mixing-tube 36 via one or more fuel ports 46. Within the mixing-tube 36, the fuel and air is mixed as both are directed by the mixing-tube 36 toward the outlet 44 formed through the aft tube-sheet 34. As discussed in more detail below, the fuel nozzle 12 may be configured such that the outlet 44 delivers the air/fuel mixture into the combustion chamber 22 where it is then combusted.

Figure 6:
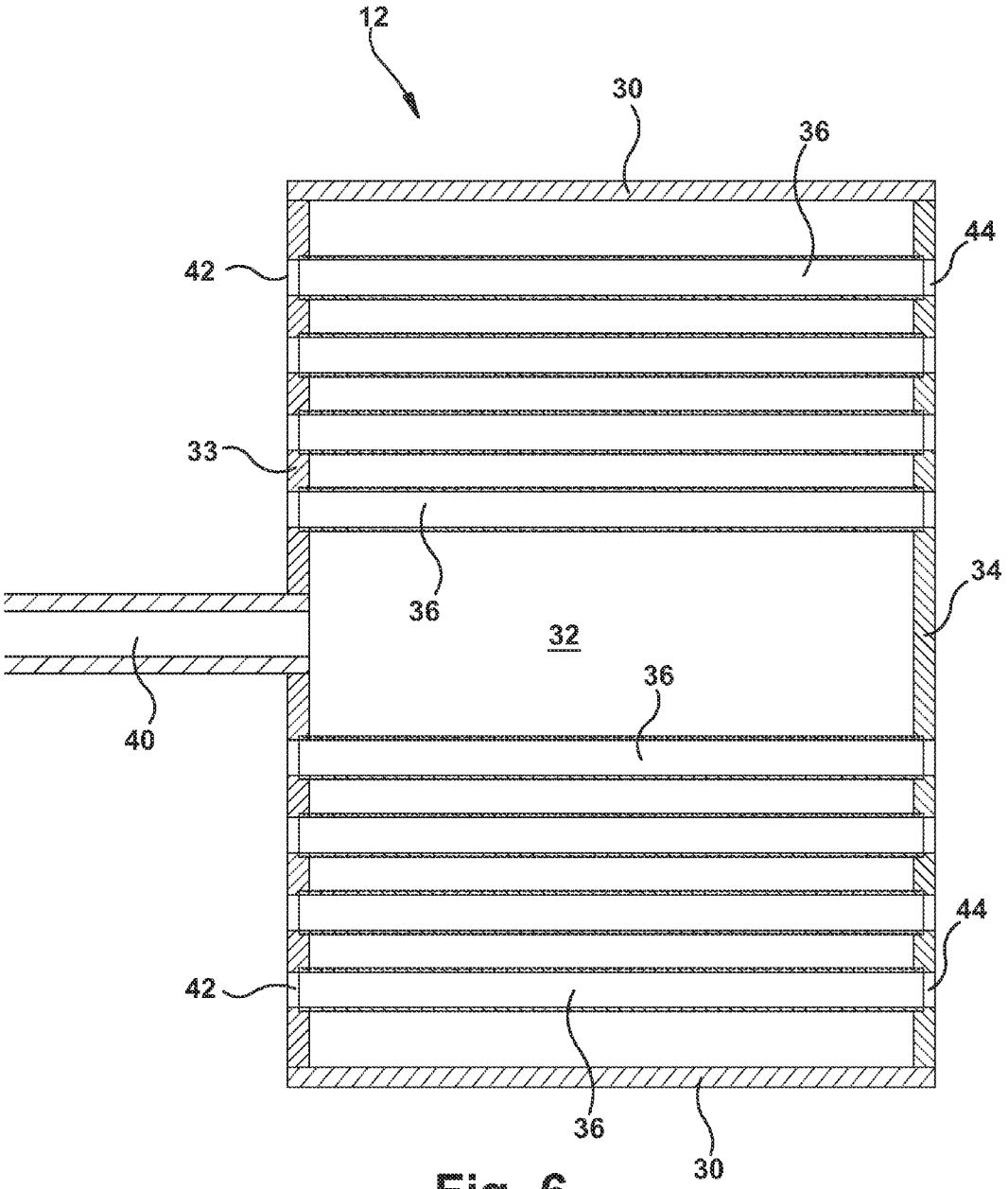
FIG. 6 is a cross-section of a fuel nozzle according to an embodiment of the present invention.

While only one mixing-tube 36 is shown traversing the fuel plenum 32 in the partial view of FIG. 3, it will be appreciated that typically a plurality of mixing-tubes 36 are positioned in this fashion within each fuel nozzle 12. Referring briefly to FIG. 6, a more complete view is provided of a fuel nozzle 12 that has a plurality of mixing-tubes 36. In such cases, as indicated in FIG. 6, the mixing-tubes 36 may be aligned radially outward of an axial centerline 48 of the nozzle 12, and be configured to extend parallel to one another along the axial length of the fuel plenum 32. The mixing-tube 36 may extend from the forward tube-sheet 33, through the fuel plenum 32, to the aft tube-sheet 34. In this manner, the mixing-tubes 36 are able to bring together a supply of fuel and compressed air and deliver the resulting air/fuel mixture to the combustion chamber 22.

It will be appreciated that the mixing-tube 36 may have a cross-section that is circular, oval, square, triangular, or any known geometric shape. In a preferred embodiment, as shown, the mixing-tube 36 has a round cross-sectional shape. The inlet 42 and outlet 43 may simply comprise openings through the forward and aft tube-sheets 33, 34 that correspond in a desired manner with the size and shape of the interior passage formed through the mixing-tube 36. The upstream and downstream ends of the mixing-tube 36 may be formed to permit air to freely flow through the mixing-tube 36 and mix with fuel injected into the mixing-tubes 36 via the fuel ports 46. The fuel ports 46 may simply comprise openings or apertures in the outer wall of the mixing-tube 36 that allows the fuel to flow from the fuel plenum 32 into the mixing-tube 36 in a desired manner and amount. The fuel ports 46 may be axially and circumferentially spaced so to encourage a more uniform mixing of fuel with the air supply moving through the mixing-tube 36. The fuel ports 46 may be angled with respect to the axial centerline 48 of the nozzle 12 to vary the angle at which the fuel enters the mixing-tube 36, thus varying the distance that the fuel penetrates into the mixing-tube 36 before mixing with the supply of air.

As one of ordinary skill in the art will appreciate, the fuel nozzle 12 is a component that may be more cost-effectively manufactured by assembling component pieces that are separately manufactured. This being the case, the mixing-tube 36 typically would not be not manufactured as an integral component to either of the tube-sheets 33, 34. It will be appreciated, however, that such assembly results in the creation of joints or seems that must be sealed to prevent leaks from occurring. In the case of a micro-mixer fuel nozzle having many separate mixing-tubes, this becomes a significant concern, as such leakage can result in fuel being expelled into areas not meant to endure the high temperatures that might result if ignited. This typically results in severe damage to the fuel injector.

Figure 4:
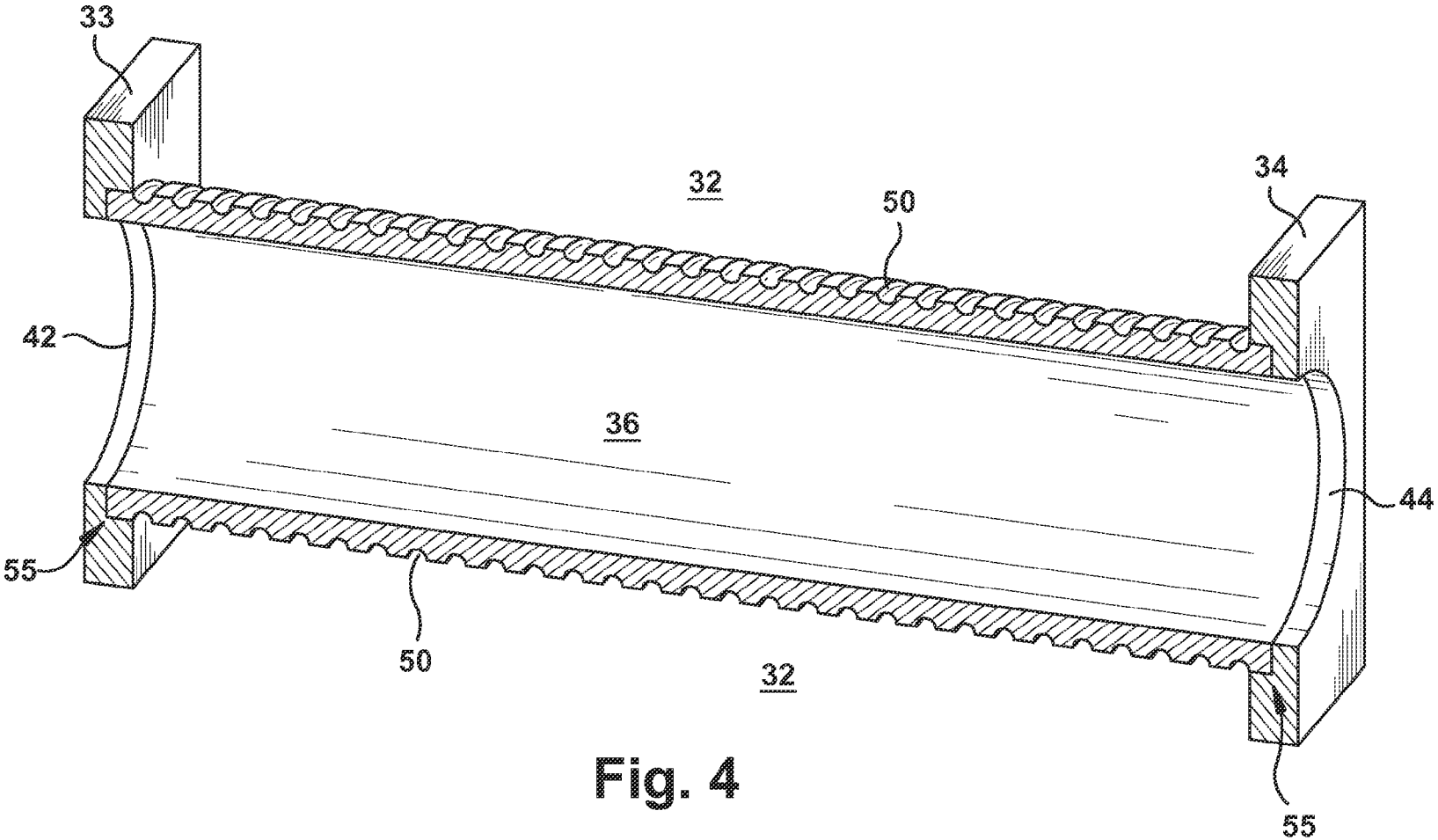
FIG. 4 is an enlarged cross-section of a mixing-tube according to one embodiment of the present invention.
Figure 5:
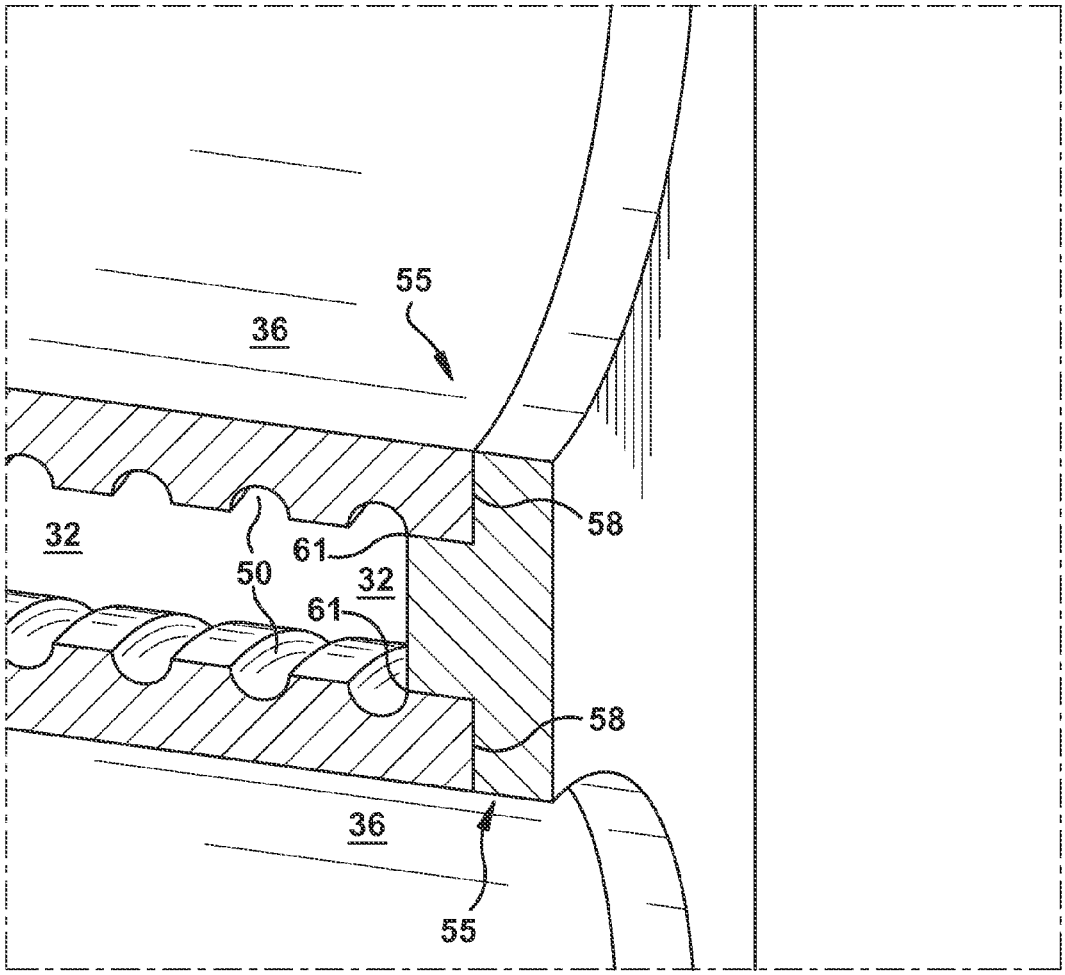
FIG. 5 is an enlarged cross-section of the connection made between a mixing-tube and a tube-sheet according to one embodiment of the present invention.

Accordingly, the present invention describes a connection 55 that both discourages the formation of a leak while also preventing the most harmful effects from occurring should a leak form along the path of the interface. As illustrated in FIGS. 4 and 5, because of the way the interface or joint surfaces of the connection 55 between the mixing-tube 36 and the tube-sheets 33, 34 are configured, the fuel nozzle 12 may be described as having a mixing-tube 36 that is enclosed within or internal to the fuel plenum 32. And, with the mixing-tube 36 being internal to the fuel plenum 32, the result is that the connection 55 provides a fail-safe leakage path. This may be accomplished, as illustrated, by engaging the mixing tube 36 with a recessed seat formed in the inlet 42 and/or the outlet 44. In a preferred embodiment, as shown in FIG. 5, the inlet 42 (or outlet 44) formed through the forward tube-sheet 33 may include a step or shoulder 58 that narrows the opening and thereby stops further migration of the mixing-tube 36 in the direction of insertion through the inlet 42. More specifically, the opening of the inlet 42 on the interior side of the forward tube-sheet 33 may be configured so that a tip-face of the mixing-tube 36 (when engaging from the interior side of the tube sheet 33, for example, during a fuel nozzle assembly process) may attain a slightly recessed position into the tube sheet 33 before the movement is arrested by the contacting the shoulders 58. The shoulders 58 may project radially inward around the circumference of the inlet 42, thereby narrowing the opening. The shoulders 58 may be cylindrical in configuration so that an annular planar surface is formed as a recessed seat against which a corresponding annular planar surface formed at the tip-face of the mixing-tube 36 may rest. As such, according to the present invention, the mixing-tube 36 is formed having a tip-face that correspond with the shoulders 58 of the inlet 42, which allows the mixing-tube 36 to attain the recessed position in the inlet 42 before engagement across a contact face occurs. The same type of connection, as indicated, may be formed between the other end of the mixing-tube and the outlet 44.

Returning again to FIG. 4, it will be appreciated that once this type of connection is formed on each side of the mixing-tube 36, the mixing-tube 36 is effectively "sandwiched" or "mechanically trapped" between the opposing tube-sheets 33, 34, which is an arrangement that bolsters the connection the mixing-tube 36 makes with the tube-sheets 33, 34, while also substantially preventing dislodgment of mixing-tube 36 component even in the case of a complete failure of the weld or brazed seal.

In addition, the probable leakage paths as defined by the resulting joint lines of the connection 55 are ones that reduce the risk of damage to the combustor should leaks eventually form. Specifically, as shown in FIG. 5, leakage from the fuel plenum 32 along the joint lines or interface merely results in the leaked fuel being injected into the mixing-tube 36. If the mixing-tube 36 were not seated on the recessed shoulders 58 formed within the inlet 42 in this manner, and, instead, extended through the inlet 42 completely so that the tip-face was flush to the outer surface of the forward tube-sheet 33, it will be appreciated that the probable leakage path defined by the joint interface would be one that leaked fuel into the area of the combustor that is upstream of the fuel nozzle 12. This area is one that could damage the combustor if such fuel leakage were ignited. The configuration of connection 55 of the present invention, however, creates a fail-safe leakage path that effectively make such a result impossible. That is, if the mixing-tube-to-tube-sheet seal should fail, the likely leakage path (as defined by the joint interface between the two components) merely results in the leaked fuel being expelled into the mixing-tube, which, because this is the intended destination of all fuel, does not result in significant damage to the combustor. Accordingly, the present invention addresses the common issue of fuel leaking into undesirable areas due to failure of the mixing-tube-to-tube-sheet braze or weld joint.

According to another aspect of the present invention, the mixing-tube 36 may also be made compliant by machining (or otherwise created) grooves 50 in its outer surface, as illustrated in FIGS. 4 and 5. It will be appreciated that the grooves 50 may be sized and shaped and oriented in several ways, but that some configurations are more preferable. For example, as illustrated, the grooves 50 are axially spaced and extend circumferentially about the mixing-tube 36. The cross-sectional shape of the grooves 50 may be semicircular or semi-oval, as shown, which will efficiently diffuse localized stresses. It will be appreciated that, along with increasing the compliancy of the mixing-tube 36, the grooves 50 also act to increase the heat transfer that occurs between the mixing-tube 36 and the fuel within the fuel plenum 32 that surrounds it. In this way, the grooves 50 operate to decrease the stresses that regularly occur and concentrate in the mixing-tube-to-tube-sheet joint due to mechanical and thermal operating loads. It will be appreciated that a more compliant mixing-tube 36 is better able spread concentrated stresses over the length of the mixing-tube 36. It will be further appreciated that the resulting increased heat transfer between the mixing-tube and the fuel in the fuel plenum 32 will lower the temperature at which the mixing-tube operates, which will decrease the thermal expansion of the mixing-tube and thereby decrease the stress such expansion causes within that joint. Further reduction in these stresses are also possible given the connection 55 of the present invention. For example, the configuration of the connection 55, as stated, results in the tip-faces of the mixing-tube 36 bearing upon the shoulders 58 formed in the inlet 42 or outlet 44. This "sandwiching" of the mixing-tube 36 bolsters the connection it makes to the fuel nozzle 12. Additionally, by locating a groove 50 at the joint edge 61, as illustrated in FIG. 5, the stresses at the region of highest concentration is efficiently dissipated.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other and examples are intended to be within the scope of the claims if they include structural elements that do not differ from the literal language of the claims, or if they include equivalent structural elements with insubstantial differences from the literal languages of the claims.

What is claimed is:

1. A combustion turbine engine having a combustor that includes a fuel nozzle in which a supply of compressed air and fuel are mixed for combustion, wherein the fuel nozzle further includes:

a fuel plenum defined between a circumferentially extending shroud and axially by a forward tube-sheet and an aft tube-sheet; and a mixing-tube that extends across the fuel plenum that defines a passageway connecting an inlet formed through the forward tube-sheet and an outlet formed through the aft tube-sheet, the mixing-tube comprising one or more fuel ports that fluidly communicate with the fuel plenum;

wherein the mixing-tube, comprises a plurality of grooves on an outer surface;

wherein the mixing-tube is attached to the forward tube-sheet and aft tube-sheet along an interface that comprises a fail-safe leakage path;

wherein the interface includes shoulders formed within each of the inlet and the outlet that engages a correspondingly shaped tip face formed on the mixing-tube, such that the mixing-tube is mechanically trapped therebetween.

2. The combustion turbine engine according to claim 1, wherein the inlet shoulder comprise a radially jutting step that narrows the inlet such that further migration of the mixing-tube in the direction of insertion is halted once engaged.

3. The combustion turbine engine according to claim 1, wherein the fail-safe leakage path comprises an interface that defines a path connecting the fuel plenum to the passageway defined by the mixing-tube.

4. The combustion turbine engine according to claim 1, wherein the shoulder of the inlet and the tip face comprises corresponding planar surfaces each of which have an annular profile.

5. The combustion turbine engine according to claim 1, wherein the forward tube-sheet comprises a forward axial boundary of the fuel nozzle; and wherein the fuel plenum extends uninterrupted axially between a first end that is defined by the forward tube-sheet and a second end that is defined by the aft tube tube-sheet.

6. The combustion turbine engine according to claim 5, wherein the aft tube-sheet comprises an aft axial boundary of the fuel nozzle, and wherein, on a hot side, the aft tube-sheet borders a combustion zone of the combustor.

7. The combustion turbine engine according to claim 1, wherein the outlet shoulder comprises a radially jutting step that narrows the outlet such that further migration of the mixing-tube in the direction of insertion is halted once engaged; and wherein the fail-safe leakage path comprises an interface that defines a path connecting the fuel plenum to the passageway of the mixing-tube.

8. The combustion turbine engine according to claim 1, wherein the grooves comprise a plurality of circumferentially extending grooves that are axially spaced on the outside surface of the mixing-tube.

9. The combustion turbine engine according to claim 8, wherein the grooves comprise one of a semi-circular and semi-oval cross-sectional shape.

10. The combustion turbine engine according to claim 9, wherein one of the grooves is positioned adjacent to a joint edge formed between the mixing-tube and forward tube-sheet.

11. The combustion turbine engine according to claim 8, wherein the fuel plenum comprises a cylindrical shape and connects to a fuel conduit that extends from a combustor end cap;

wherein the fuel nozzle comprises a plurality of separated mixing-tubes, each of the mixing-tubes comprising a cylindrical shape; and wherein each mixing-tube comprises a plurality of axially spaced fuel ports.

12. A fuel nozzle for a combustor of a combustion turbine engine, the fuel nozzle comprising:

a fuel plenum defined by a shroud that extends between a forward tube-sheet and an aft tube-sheet;

a plurality of mixing-tubes, each of which defines an enclosed passageway extending across the fuel plenum from an inlet formed through the forward tube-sheet to an outlet formed through the aft tube-sheet, wherein each of the mixing-tubes includes a plurality of fuel ports that fluidly connects the enclosed passageway to the fuel plenum;

wherein each of the mixing-tubes comprises a plurality of grooves formed on an outer surface, the plurality of grooves configured to increase a compliancy of each mixing-tube; and wherein the mixing-tube comprises a non-integral component to both the forward tube-sheet and the aft tube-sheet, wherein the mixing-tube is mechanically trapped therebetween via a first tip face of the mixing-tube engaging a recessed seat formed in the inlet and a second tip face of the mixing-tube engaging a recessed seat formed in the outlet.

13. The fuel nozzle according to claim 12, wherein the recessed seat in the inlet includes a shoulder that narrows the inlet so that migration of the mixing-tube in the direction of insertion is prevented upon engagement of the shoulder by the first tip face; and wherein the recessed seat in the outlet includes a shoulder that narrows the outlet so that migration of the mixing-tube in the direction of insertion is prevented upon engagement of the shoulder by the second tip face.

14. The fuel nozzle according to claim 13, wherein the recessed seat in the inlet comprises one positioned within a thickness of the forward tube-sheet; and wherein the recessed seat in the outlet comprises one positioned within a thickness of the aft tube-sheet.

15. The fuel nozzle according to claim 13, wherein the grooves comprise a plurality of circumferentially extending grooves that are axially spaced on the outside surface of the mixing-tube.

16. The fuel nozzle according to claim 15, wherein the grooves comprise one of a semi-circular and semi-oval cross-sectional shape.

17. The fuel nozzle according to claim 15, wherein one of the grooves is positioned adjacent to a joint edge formed between each of the mixing-tubes and the forward tube-sheet.

18. The fuel nozzle according to claim 15, wherein one of the grooves is positioned adjacent to a joint edge formed between each of the mixing-tubes and the forward tube-sheet; and wherein a second of the grooves is positioned adjacent to a joint edge formed between each of the mixing-tubes and the aft tube-sheet.

* * * * *